US006743367B2

(12) United States Patent
Dreyer

(10) Patent No.: US 6,743,367 B2
(45) Date of Patent: Jun. 1, 2004

(54) BOOM CURTAIN WITH EXPANDABLE PLEATED PANELS, CONTAINMENT BOOM CONTAINING THE SAME, AND USE THEREOF

(75) Inventor: Harold B. Dreyer, Anchorage, AK (US)

(73) Assignee: Gunderboom, Inc., Anchorage, AK (US)

( * ) Notice: Subject to any disclaimer, the term of this patent is extended or adjusted under 35 U.S.C. 154(b) by 0 days.

(21) Appl. No.: 10/283,384

(22) Filed: Oct. 29, 2002

(65) Prior Publication Data

US 2003/0082006 A1 May 1, 2003

Related U.S. Application Data

(60) Provisional application No. 60/347,959, filed on Oct. 29, 2001.

(51) Int. Cl.[7] ..... E03B 1/00; E02B 15/00

(52) U.S. Cl. ..... 210/747; 210/170; 210/242.1; 405/63; 405/127

(58) Field of Search ..... 210/747, 170, 210/242.1, 493.1; 405/63, 70, 127

(56) References Cited

U.S. PATENT DOCUMENTS

| | | | | |
|---|---|---|---|---|
| 3,659,713 A | | 5/1972 | Mueller | |
| 3,667,235 A | * | 6/1972 | Preus et al. | 210/242.1 |
| 3,713,540 A | | 1/1973 | Davidson et al. | |
| 3,979,289 A | | 9/1976 | Bykowski et al. | |
| 4,178,245 A | | 12/1979 | Nakaoka et al. | |
| 4,219,423 A | | 8/1980 | Smith, Jr. | |
| 4,288,321 A | | 9/1981 | Beane | |
| 4,296,884 A | | 10/1981 | Luebke | |
| 4,419,232 A | | 12/1983 | Arntyr et al. | |
| 4,582,048 A | | 4/1986 | Sorensen | |
| 4,664,792 A | * | 5/1987 | Fors et al. | 210/747 |
| 4,669,972 A | | 6/1987 | Koblanski | |
| 4,692,059 A | | 9/1987 | Juutilainen | |
| 4,738,563 A | | 4/1988 | Clark | 405/63 |
| 4,749,479 A | | 6/1988 | Gray | |
| 4,880,333 A | | 11/1989 | Glasser et al. | |
| 4,919,820 A | | 4/1990 | Lafay et al. | |
| 5,071,286 A | | 12/1991 | Separovich | 405/70 |
| 5,102,261 A | | 4/1992 | Gunderson, III | |
| 5,197,821 A | | 3/1993 | Cain et al. | |
| 5,220,958 A | | 6/1993 | Bernhardt | |
| 5,225,622 A | | 7/1993 | Gettle et al. | |
| 5,232,310 A | | 8/1993 | Wirkala | 405/70 |
| 5,322,629 A | | 6/1994 | Stewart | |
| 5,345,741 A | | 9/1994 | Slater et al. | |
| 5,354,456 A | | 10/1994 | Montgomery et al. | |
| 5,354,459 A | | 10/1994 | Smith | |
| 5,366,322 A | * | 11/1994 | Hurwitt | 210/170 |

(List continued on next page.)

FOREIGN PATENT DOCUMENTS

| | | |
|---|---|---|
| FR | 2195-238 | 8/1972 |
| FR | 2284-709 | 9/1974 |
| FR | 2329-808 | 11/1975 |
| FR | 2579-239 A | 3/1985 |
| GB | 2 246 981 A | 2/1992 |
| WO | WO 91/07546 | 5/1991 |
| WO | WO 99/19570 | 4/1999 |

*Primary Examiner*—Christopher Upton
(74) *Attorney, Agent, or Firm*—Nixon Peabody LLP

(57) ABSTRACT

A boom curtain includes: an upper portion that is adapted and configured for connection to a support system and a main portion formed of a sheet of flexible material that allows the flow of water therethrough, the main portion including a plurality of pleats that effectively increase the actual surface area of the boom curtain relative to the linear area covered by the boom curtain. A containment/exclusion boom that includes the boom curtain and a method of filtering intake water by using the boom are also disclosed.

18 Claims, 3 Drawing Sheets

U.S. PATENT DOCUMENTS 5,372,711 A 12/1994 Sill
5,394,786 A 3/1995 Gettle et al.
5,427,679 A 6/1995 Daniels
5,558,462 A 9/1996 O'Haver
5,688,075 A * 11/1997 Gradek ..... 405/63
RE36,297 E 9/1999 Heino et al.
5,992,104 A 11/1999 Hudak
6,346,193 B1 2/2002 Bauer ..... 210/170
2002/0080681 A1 6/2002 Dreyer et al.
2002/0185449 A1 * 12/2002 Turner, Jr. et al. ..... 210/747

* cited by examiner

BOOM CURTAIN WITH EXPANDABLE PLEATED PANELS, CONTAINMENT BOOM CONTAINING THE SAME, AND USE THEREOF

This application claims the priority benefit of U.S. Provisional Patent Application Serial No. 60/347,959 filed Oct. 29, 2001, which is hereby incorporated by reference in its entirety.

FIELD OF THE INVENTION

The present invention relates to a boom curtain that includes expandable, pleated panels, as well as a containment/exclusion boom containing such a boom curtain.

BACKGROUND OF THE INVENTION

Containment/exclusion booms can be used to filter water or to restrict the flow of debris and contaminants from one side of the boom to the other. Such contaminants can include any debris or marine or aquatic life, as well as silt which is laden with bacteria. Unfortunately, the area available for the boom curtain placement is some bodies of water is not adequate to hold a curtain, the size of which would be required for the desired level of filtering. It would be desirable, therefore, to develop a boom system that is capable of overcoming this problem and affording filtration and/or exclusion capabilities in waters where existing boom systems cannot do so.

The present invention overcomes these and other deficiencies in the art.

SUMMARY OF THE INVENTION

A first aspect of the present invention relates to a boom curtain that includes: an upper portion that is adapted and configured for connection to a support system and a main portion formed of a sheet of flexible material that allows the flow of water therethrough, the main portion including a plurality of pleats that effectively increase the actual surface area of the boom curtain relative to the linear area covered by the boom curtain.

A second aspect of the present invention relates to a containment/exclusion boom that includes: a support system which can be positioned in a body of water; and a boom curtain that includes an upper portion connected to the support system and a main body portion, the main body portion being formed of a flexible material that allows the flow of water therethrough and including a plurality of pleats formed therein, the plurality of pleats effectively increasing the actual surface area of the boom curtain relative to the linear area covered by the boom curtain.

A third aspect of the present invention relates to a method of filtering water in a body of water, the method including: introducing a containment/exclusion boom of the present invention into a body of water at a location between an inlet into the body of water and a water intake located within the body of water; and removing water from the body of water via the water intake, whereby water entering via the inlet passes through the curtain of the containment/exclusion boom before said removing.

The boom curtain of the present invention allows the use of containment/exclusion booms in environments where water filtration via boom systems would not otherwise be available because the linear area over which filtration can occur would otherwise be insufficient. By expanding the surface area over which filtration occurs through the use of a boom curtain of the present invention, it becomes possible to install and utilize boom systems for filtration of water entering an intake system. This is of significant importance in various industries that employ water-cooling systems, who will be able to utilize the boom system of the present invention to comply with governmental regulations (regarding exclusion of aquatic biota) rather than installing expensive dry cooling towers. The boom curtains constructed with geosynthetic fabric materials allow permanent or semi-permanent installation of boom systems, which can also minimize the necessity of shutting down water intake systems for routine cleaning and maintenance.

DETAILED DESCRIPTION OF THE INVENTION

Figure 1:
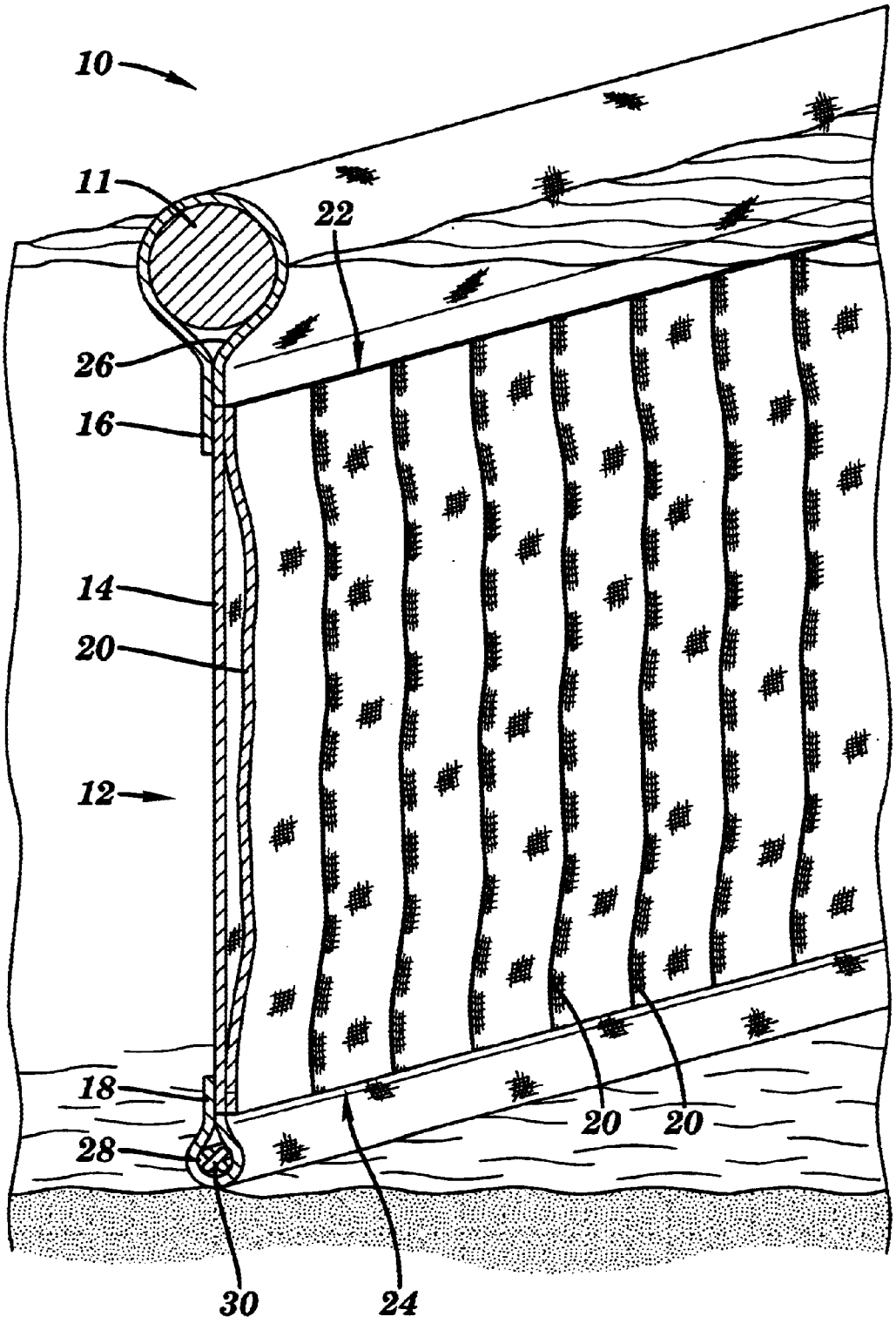
FIG. 1 is an environmental perspective view of a boom curtain of the present invention installed onto a containment/exclusion boom of the present invention.

With reference to FIG. 1, a containment/exclusion boom 10 of the present invention includes a support system 11 which can be positioned in a body of water and a boom curtain 12 connected to the support system.

The boom curtain 12 of the present invention includes a main body portion 14, an upper portion 16, and optionally a bottom portion 18. Each of these three portions can be present in a single lengthwise section, and multiple sections can be attached together to extend the length of the boom curtain.

Figure 2:
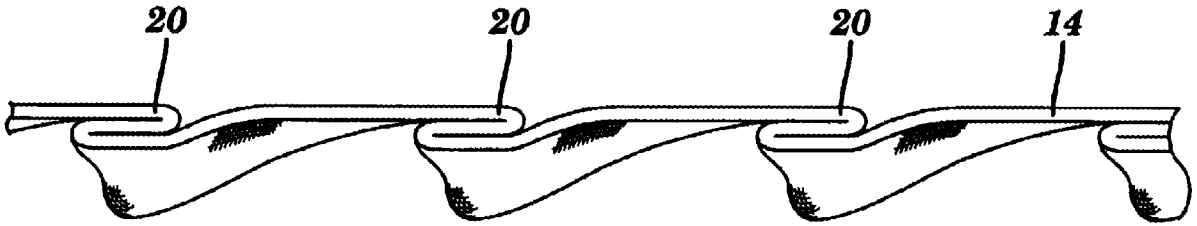
FIG. 2 is a top plan view of the main body portion of a boom curtain according to one embodiment of the present invention.
Figure 3:
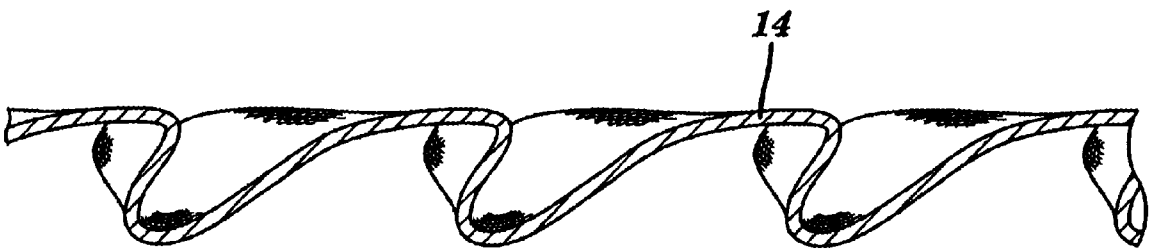
FIG. 3 is a cross-sectional view through the main body portion of the boom curtain shown in FIG. 2.
Figure 4:
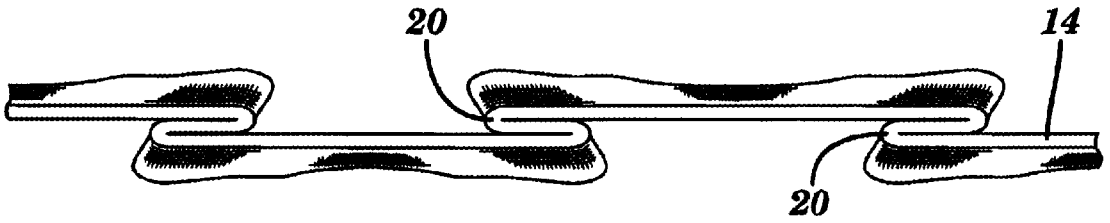
FIG. 4 is a top plan view of the main body portion of a boom curtain according to another embodiment of the present invention.
Figure 5:
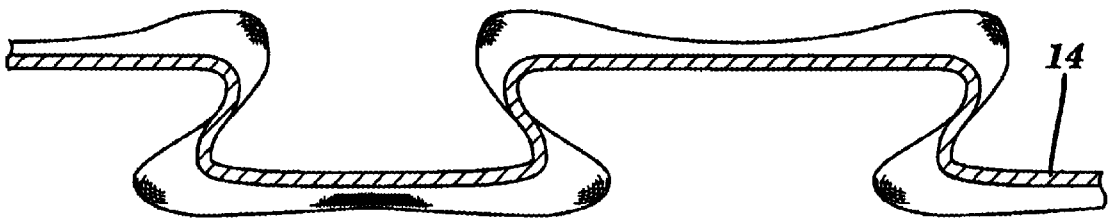
FIG. 5 is a cross-sectional view through the main body portion of the boom curtain shown in FIG. 4.

The main body portion 14 is formed from at least one sheet of flexible fabric that allows movement of water therethrough. When only a single sheet of flexible fabric is employed, the single sheet includes a plurality of pleats 20 formed therein. When two or more sheets of flexible fabric are used, both sheets may include a plurality of pleats or a first sheet can be non-pleated and a second sheet can be pleated. As shown, the main body portion 14 has vertically aligned pleats, i.e., running between the upper and lower portions 16,18. Any of a variety of pleat configurations can be utilized, including pleats running in the same direction (FIGS. 2 and 3) as well as pleats running in opposite directions (FIGS. 4 and 5). The plurality of pleats 20 can be formed by sewing, heat fusion, or use of marine adhesives to secure together overlapping portions of the main body portion 14 along the edges thereof (e.g., at upper edge 22 and lower edge 24). Though not shown, it should be appreciated by those of skill in the art that horizontally or diagonally aligned pleats can also be utilized.

Although not shown, it should be appreciated that reinforcement webbing can be sewn or heat fused to the regions of the curtain 10 where different portions are connected together as well as over the regions where the pleats are formed. The webbing can effectively minimize strain applied to those connections.

Regardless of the construction, the plurality of pleats 20 effectively increases the actual surface area of the boom curtain 12 relative to the linear area covered by the boom curtain. For example, a conventional boom curtain may be 15 feet by 30 feet in construction, having an approximately 450 square foot linear area when installed on a conventional containment/exclusion boom. In contrast, by forming a boom curtain in the present invention using, for example, a curtain which is 15 feet by 40 feet and pleated such that its overall length is 30 feet, the surface area is approximately 600 square feet. In comparison to its linear area, the boom curtain of the present invention preferably has a surface area which is at least 5 percent greater, preferably at least 10 percent greater, more preferably at least 15 percent greater. Depending upon the filtration needs of a particular installation, the surface area of the boom curtain may be increased to about twice the linear area (i.e., 100 percent increase) of the boom curtain.

This main body portion has an upper edge 22 and a lower edge 24. The main body portion is connected at its upper edge to the upper portion 16 and at its lower edge to the bottom portion 18. The connections may be formed by sewing, heat fusion, marine adhesives, etc. Alternatively, for more flexibility in adjusting the containment/exclusion boom to a particular site, the main body portion can be connected to the upper portion or bottom portion using zipper connections of the type disclosed in copending U.S. Patent Application entitled "Boom Curtain with Zipper Connections and Method of Assembling Boom" to Dreyer, filed Oct. 11, 2002, which is hereby incorporated by reference in its entirety.

For most applications it is sufficient to construct the boom curtain, and particularly the main body portion 14, with a single layer of geosynthetic fabric. However, for some applications, a multilayer construction may be desirable to provide added strength or protection against abrasion. The layers could be of the same geosynthetic fabric or different fabrics. For instance, a curtain might have a first layer of nonwoven fabric and a second layer of a woven fabric, which would tend to be more abrasive-resistant than the nonwoven fabric. The fabric can optionally be custom designed to provide for greater or lesser water flow therethrough, as described in U.S. patent application Ser. No. 09/168,491 to Gunderson et al., filed Oct. 8, 1998, which is hereby incorporated by reference in its entirety.

The flexible fabric is preferably a geosynthetic fabric, which can be either woven or non-woven. The geosynthetic fabric is "hydrophobic" or "water-pervious," meaning that water passes through the fabric. The hydrophobic property of geosynthetic fabric permits the passage of water current through the main body portion of the curtain, thereby maintaining the relative shape and position of the boom even in adverse current conditions, and also facilitating towing.

Typically, the geosynthetic fabric will be "oleophilic," meaning that it absorbs or attracts oil, thereby blocking the flow of oil. For containment of silt and other suspended particulates, it is not essential that the curtain be oleophilic; obviously, for containment of oil, the curtain preferably is oleophilic. Useful geosynthetic fabrics are further characterized by high load distribution capacity, the ability to abate material filtration, and permeability to water. Geosynthetic fabrics are commercially available in a range of tensile strengths, permeabilities, and permitivities, and are useful for the purposes of the invention throughout those ranges.

The geosynthetic fabrics are nonbiodegradable, so they do not deteriorate due to environmental exposure. During prolonged use, exposure to ultraviolet (UV) light may cause some geosynthetic fabrics to weaken or deteriorate. However, UV-resistant fabrics are commercially available as well as UV resistance treatment methods.

Geosynthetic fabric may be prepared using one or a combination of various polymers, for example polyester, polypropylene, polyamides, and polyethylene. Most commercially available geosynthetic fabrics are polypropylene or polyester. Examples of suitable nonwoven geosynthetic fabrics include, but are not limited to, AMOPAVE® 4399, AMOPAVE® HD 4597, 4545, 4553, and 4561 (all polypropylene fabrics commercially available from Amoco Fabrics and Fibers Company); Typar®, a polypropylene fabric commercially available from Dupont; TREVIRA® Spunbond, a polyester fabric commercially available from Hoechst Fibers Industries. Examples of suitable woven geosynthetic fabrics include, but are not limited to, 1380 SILT STOP®, 1198, 1199, 2090, 2000, 2006 (all polypropylene fabrics commercially available from Amoco Fabrics and Fibers Company).

The upper portion 16 is adapted and configured for its attachment to a support system. As shown in FIG. 1, a floating support system is utilized (as described below). To accommodate the floating support system, the upper portion includes a sleeve 26 extending substantially the entire length of the boom curtain section. The sleeve 26 is designed to receive the floatation billets of support system 11. The upper portion is preferably formed of the same material used to form the main body portion, although different fabric materials can certainly be employed.

The lower portion 18 is adapted and configured for its attachment to an anchoring system. As shown in FIG. 1, a ballast type anchoring system 30 is utilized (as described below). To accommodate the ballast, the lower portion includes a sleeve 28 extending substantially the entire length of the boom curtain section. The sleeve 26 is designed to receive the ballast 30 therein. The lower portion is preferably formed of the same material used to form the main body portion, although different fabric materials can certainly be employed.

When the boom curtain is utilized to prepare a containment/exclusion boom, the boom curtain 10 can be connected to a support system and an anchoring system which is designed to maintain at least the lower portion of the boom curtain substantially against the floor of a body of water (i.e., after its installation).

As shown in FIG. 1, a floating support system is illustrated. Floating support systems can include a plurality of conventional flotation units usable with the present invention, such as inflatable devices, air bags, and floats made from buoyant materials, such as cork, synthetic foams, and other plastics. However, conventional devices may not perform adequately under adverse conditions. It has been found that under adverse conditions, expanded polystyrene ("EPS") is especially suitable for use as the flotation unit. It is desirable to coat or seal the EPS to prevent deterioration associated with prolonged exposure to the elements. EPS is commercially available from ARCO Chemical Company as DYLITE® and can be formed or molded into flotation units of various sizes and shapes (e.g., cylindrical, square, etc.) as required by project design. The EPS has a positive buoyancy that keeps the flotation unit substantially above the water surface at all times, allowing the flotation unit to ride the waves, even in adverse conditions. An EPS flotation unit is not deformed by wave action and does not lose buoyancy if punctured, as would an inflatable device. A single cubic foot of EPS can support as much as 60 lbs. A commonly used size of flotation unit of EPS is an 8" to 12" diameter cylindrical configuration, but the size can be readily adapted to meet specific wave and environmental conditions and depth requirements. To accommodate the installation of flotation units into upper sleeve 26, the sleeve can be provided with a series of slits along its length.

Depending upon the circumstances of the installation, a permanent or semi-permanent support system can be used rather than the floating support system afforded by use of the EPS or other buoyant materials. Such support systems can include pilings of conventional construction and horizontal support members (i.e., a wire, beam, catwalk, or other like support) which extend between adjacent pilings. The boom curtain can be connected to either the horizontal support members or both the horizontal support members and the pilings. These alternative support systems are described in U.S. patent application Ser. No. 09/168,491 to Gunderson et al., which is hereby incorporated by reference in its entirety.

To maintain the bottom of the boom curtain at least substantially in contact with the bottom of the body of water, an anchor or ballast of some type can be connected to the boom curtain. Typically, the ballast is a continuous length of chain or cable of sufficient weight to hold the curtain in a substantially vertical orientation below the support system.

Ballasts such as lengths of steel chain (from less than ⅛ inch to over ¾ inch) and steel cable (from less than ¾ inch to over 1½ inches in diameter) have been used. Of course, chains and cables of greater or less diameter may be used to meet the specific requirements of a project design. Moreover, it is not always necessary to utilize a lower sleeve 28 to contain ballast. Ballast chains, cable, or weighted cable can be tied with wire or other means to the curtain at its bottom (or to the bottom portion).

In adverse wave and current conditions, the ballast alone may not be sufficient to maintain the containment boom in place or the curtain in a substantially vertical orientation. It would therefore be desirable to employ an anchor or a series of anchors to secure the boom in place. The anchors can be attached to the bottom of the curtain or to the ballast. For booms of considerable length, anchors preferably are attached at regular intervals. Anchor location may be marked by brightly colored buoys, as necessary.

Alternatively, Y-panel or J-panel bottom curtains can be used in conjunction with traditional or non-traditional anchoring systems to secure the boom in a fixed position. Y-panel bottom curtains and anchoring systems are disclosed in U.S. patent application Ser. No. 10/134,359 to Dreyer, filed Apr. 26, 2002, which is hereby incorporated by reference in its entirety.

The containment boom of the invention can also include one or more tow cords secured to the curtain. The tow cords are used to tow the boom into position or from one location to another. The two cords can be bands or strips of nylon lifting straps, steel or aluminum cable, polypropylene rope, geosynthetic material, or the like that extend the length of the curtain and can be secured to the curtain or portions thereof in a manner disclosed in U.S. Pat. No. 5,102,261 to Gunderson, which is hereby incorporated by reference in its entirety. Depending on the overall length of the curtain and other design parameters, additional tow cords may be positioned on the curtain or portions thereof as necessary.

The boom of the invention can be deployed throughout the full water column, i.e., from the surface to the floor of a body of water. The flotation unit may be on the water surface or submerged, with a curtain extending down through the water toward the floor. For example, the boom may be submerged to allow movement of vessel traffic or ice. With properly installed ballasts and/or anchors, the boom can remain stationary under moving ice, thereby acting to stop pollutants from migrating from the water surface downward to the sea floor and then beyond the containment area.

The boom system can be deployed from a barge, a dock with a small boat, or other surface or access point near the water. The invention is uncomplicated in design and can be easily deployed by persons having basic waterfront experience without prior training in containment boom deployment.

In use, the boom system can be deployed, e.g., about a water intake system for purposes of filtering water entering the intake system. This is achieved by introducing the boom system of the present invention into a body of water at a location between an inlet into the body of water and a water intake located within the body of water, and then removing water from the body of water via the water intake. As a result of the boom system location, water entering via the inlet passes through the curtain of the boom before it enters the water intake.

Although preferred embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

What is claimed is:

1. A containment/exclusion boom comprising:

a support system which can be positioned in a body of water; and a boom curtain comprising an upper portion connected to the support system and a main body portion, the main body portion being formed of a flexible material that allows the flow of water therethrough and including a plurality of permanent pleats formed therein, the plurality of permanent pleats effectively increasing the actual surface area of the boom curtain relative to the linear area covered by the boom curtain.

2. The containment/exclusion boom according to claim 1 wherein the boom curtain further comprises a bottom portion, the boom further comprising:

means, connected to the bottom portion of the boom curtain, for maintaining at least the bottom portion of the boom curtain substantially against the floor of a body of water upon introduction of the containment/exclusion boom into the body of water.

3. The containment/exclusion boom according to claim 1 wherein the actual surface area is at least 5 percent greater than the linear area.

4. The containment/exclusion boom according to claim 1 wherein the actual surface area is at least 10 percent greater than the linear area.

5. The containment/exclusion boom according to claim 1 wherein the actual surface area is at least 15 percent greater than the linear area.

6. The containment/exclusion boom according to claim 1 wherein the boom curtain is formed of a geosynthetic fabric.

7. The containment/exclusion boom according to claim 1 wherein the support system comprises a floating support system.

8. The containment/exclusion boom according to claim 1 wherein the support system is a permanent or semi-permanent structure.

9. The containment/exclusion boom according to claim 1 wherein the plurality of permanent pleats are vertically arranged.

10. A boom curtain comprising an upper portion that is adapted and configured for connection to a support system and a main portion formed of a sheet of flexible material that allows the flow of water therethrough, the main portion including a plurality of permanent pleats that effectively increase the actual surface area of the boom curtain relative to the linear area covered by the boom curtain.

11. The boom curtain according to claim 10 wherein the upper portion of the boom curtain is in the form of a sleeve.

12. The boom curtain according to claim 10 further comprising a lower portion of the boom curtain in the form of a sleeve.

13. The boom curtain according to claim 10 wherein the actual surface area is at least 5 percent greater than the linear area.

14. The boom curtain according to claim 10 wherein the actual surface area is at least 10 percent greater than the linear area.

15. The boom curtain according to claim 10 wherein the actual surface area is at least 15 percent greater than the linear area.

16. The boom curtain according to claim 10 wherein the boom curtain is formed of a geosynthetic fabric.

17. The boom curtain according to claim 10 wherein the plurality of pleats are vertically arranged.

18. A method of filtering water in a body of water comprising:

introducing a containment/exclusion boom into a body of water at a location between an inlet into the body of water and a water intake located within the body of water, the containment/exclusion boom comprising a support system positioned in the body of water and a boom curtain including an upper portion that is connected to the support system and a main body portion, the main body portion being formed of a flexible material that allows the flow of water therethrough and including a plurality of pleats formed therein, the plurality of pleats effectively increasing the actual surface area of the boom curtain relative to the linear area covered by the boom curtain; and removing water from the body of water via the water intake, whereby water entering via the inlet passes through the curtain of the containment/exclusion boom before said removing.

* * * * *